US005340502A

United States Patent [19]

Palicka

[11] Patent Number: 5,340,502

[45] Date of Patent: Aug. 23, 1994

[54] LIQUID DISHWASHING COMPOSITIONS COMPRISING ANIONIC TENSIDE AND THREE AMPHOTERIC COMPOUNDS

[75] Inventor: Jadwiga Palicka, Lidingo, Sweden

[73] Assignee: Berol Novel AB, Stenungsund, Sweden

[21] Appl. No.: 977,153

[22] Filed: Nov. 16, 1992

[30] Foreign Application Priority Data

Nov. 21, 1991 [SE] Sweden ..... 9103453-8

[51] Int. Cl.[5] ..... C11D 1/88; C11D 1/90; C11D 1/94

[52] U.S. Cl. ..... 252/546; 252/547; 252/548; 252/DIG. 7

[58] Field of Search ..... 252/546, 547, 548, DIG. 7

[56] References Cited

U.S. PATENT DOCUMENTS

| | | | |
|---|---|---|---|
| 4,732,692 | 4/1986 | Zabotto et al. | 252/106 |
| 4,769,169 | 9/1988 | Fishlock-Lomax | 252/106 |
| 4,802,997 | 2/1989 | Fox et al. | 252/8.6 |
| 4,946,136 | 8/1990 | Fishlock-Lomax | 252/546 |
| 5,156,761 | 10/1992 | Aaslyng et al. | 252/174.12 |

FOREIGN PATENT DOCUMENTS

| | | |
|---|---|---|
| 0160507 | 11/1985 | European Pat. Off. . |
| 0162600 | 11/1985 | European Pat. Off. . |
| 0214868 | 3/1987 | European Pat. Off. . |
| 0250181 | 12/1987 | European Pat. Off. . |
| 0373851 | 6/1990 | European Pat. Off. . |
| 0508507 | 10/1992 | European Pat. Off. . |
| 9205236 | 4/1992 | World Int. Prop. O. . |

*Primary Examiner*—Paul Lieberman
*Assistant Examiner*—Erin Higgins
*Attorney, Agent, or Firm*—Fred Philpitt

[57] ABSTRACT

Liquid dishwashing composition comprising anionic tenside and a combination of three types of amphoteric compounds. The three types of amphoteric compounds can be characterized by the general formulae

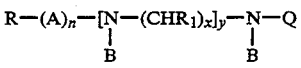

type a)

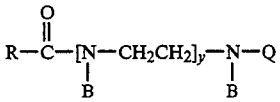

type b)

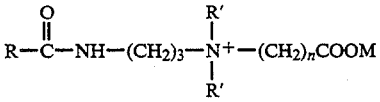

type c)

2 Claims, No Drawings

LIQUID DISHWASHING COMPOSITIONS COMPRISING ANIONIC TENSIDE AND THREE AMPHOTERIC COMPOUNDS

The present invention relates to liquid dishwashing compositions and more particularly to such compositions which contain an anionic tenside and a combination of specific amphoteric surface active agents.

The most common commercial liquid dishwashing compositions are primarily intended for hand dishwashing and are as a rule aqueous solutions containing anionic tensides, such as alkyl sulfonates, alkylbenzene sulfonates and alkyl ether sulfates, as essential component. These dishwashing agents are entirely satisfactory with regard to cleaning effect, foam forming effect and foam stability. However, the dishwashing compositions based on this type of anionic surface active agents are not satisfactory with regard to mildness to skin, since they have a certain irritating and allergy causing effect. There is thus a great interest in producing dishwashing compositions which are mild to the skin and at the same time give a good cleaning effect.

The anionic surface active agents are the primary tensides in the dishwashing compositions and give primarily the cleaning effect. Secondary tensides are used in dishwashing agents to give additional advantageous effects such as foam boasting and reduced skin irritation. Amine oxides, fatty acid alkanol amines and amphoteric surface active agents such as betaines and amido betaines are often used as secondary surfactants.

According to the present invention it has been found that dishwashing agents which are extremely mild to the skin and which at the same time retain their good cleaning effect can be obtained by utilization of a combination of three different types of amphoteric surface active agents in dishwashing agents based on anionic tensides. Dishwashing compositions according to the invention are especially suitable for manual washing, of glass, china, kitchen utensils etc, thanks to their mildness. The dishwashing compositions are further advantageous since they are "self-preservative" and addition of special preservatives is not required.

The present invention thus relates to a dishwashing composition as further specified in the appended claims.

In the dishwashing compositions of the present invention a combination of three types of amphoteric compounds are used and these are below designated as type a), type b) and type c). The amphoteric surface active agents of type a) are characterized by the general formula (I)

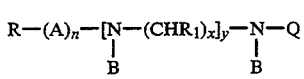

$$R-(A)_n-[\underset{\underset{B}{|}}{N}-(CHR_1)_x]_y-\underset{\underset{B}{|}}{N}-Q \quad (I)$$

wherein R is a hydrocarbon group having from 7 to 22 carbon atoms, n is 0 or 1, A is a carbonyl group [C(O)], a group $(OCH_2CH_2)_z$ or $(OCH_2CH_2CH_2)_z$ wherein z is an integer of from 1 to 5, $R_1$ is hydrogen or a lower alkyl group, x is 2 or 3, y is an integer of 0 to 4, Q is the group $-R_2COOM$ wherein $R_2$ is an alkylene group having from 1 to 6 carbon atoms and M is hydrogen or an ion from the groups alkali metals, alkaline earth metals, ammonium and substituted ammonium and B is hydrogen or a group Q as defined.

Amphoteric compounds of the above type are per se known and used in cleaning compositions and shampoo compositions. They are disclosed in, among others, the European patent applications 160507, 162600 and 214868. In the amphoteric surface active compounds of type a) utilized in the present dishwashing compositions R is a hydrocarbon group having from 7 to 22 carbon atoms and suitably having from 11 to 22 carbon atoms. The hydrocarbon group R can be straight or branched, saturated or unsaturated and optionally contain substituents such as hydroxyl groups. The group R can also be a cycloalkyl-alkyl group, an aralkyl or aralkenyl group wherein the alkyl- or alkenyl group contains at least 6 carbon atoms. It is preferred that R is an alkyl group or an alkenyl group and it is especially preferred that R is a hydrocarbon group originating from coco, tallow or oleic fatty acid. The amphoteric compounds can, as indicated above, contain a group A which is a carbonyl group or one or several ethoxy or propoxy groups. When A consists of ethoxy or propoxy groups ethoxy groups are preferred and A is most preferably then one such group. Compounds which do not contain a group A, i.e. those in which n is 0, are preferred. $R_1$ in the given formula is hydrogen or a lower alkyl groups, suitably with 1 to 6 carbon atoms and preferably hydrogen or a methyl group x is 2 or 3 and y is suitably 2, 3 or 4 and preferably 2 or 3. The group $R_2$is suitably a methylene or ethylene group, preferably a methylene group. M is hydrogen or an ion from the groups alkali metals, alkaline earth metals, ammonium or substituted ammonium such as mono-, di- or trihydroxyethyl ammonium. It is preferred that M is a sodium ion.

Preferred compounds of formula (I) have the formula (II):

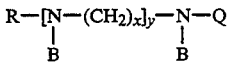

$$R-[\underset{\underset{B}{|}}{N}-(CH_2)_x]_y-\underset{\underset{B}{|}}{N}-Q \quad (II)$$

wherein Q is $CH_2$—COOm or $CH_2CH_2$—COOM, y is 1, 2 or 3 and wherein M, R, x and B have the meanings given above. X is suitably 3 and all groups B are suitably groups Q.

Mixtures of the amphoteric compounds with different values for y are especially preferred. R in these compounds suitably originates from tallow, oleic or coco fatty acid.

In the present compositions the amphoteric compounds of the above given formulae are used in combination with amphoteric compounds of imidazoline type. These amphoteric compounds of type b) can be characterized by the general formula (III)

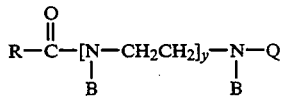

$$R-\overset{\overset{O}{\|}}{C}-[\underset{\underset{B}{|}}{N}-CH_2CH_2]_y-\underset{\underset{B}{|}}{N}-Q \quad (III)$$

wherein R, y, Q and B have the same meanings as given above for compounds of formula (I) whereby however one group B is the group $-CH_2CHR'OH$, where R' is H or $CH_3$. The suitable and preferred definitions for R and for M in the group Q are the same as those given for compounds of formula (I). Most suitable are compounds of formula (III) wherein y is 1 and Q is the group $-CH_2COOM$. As typical examples can be given compounds of the formulae (Ilia) and/or (IIIb)

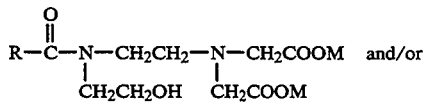

(IIIa)

and/or

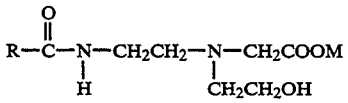

(IIIb)

Amphoteric compounds of formulae IIIa and IIIb are commercially available as mixtures and usually with a weight ratio of compounds of formula IIIa to IIIb within the range 1:10 to 10:1.

The third type, type c), of amphoteric compounds is an amidobetaine and can be characterized by the general formula (IV)

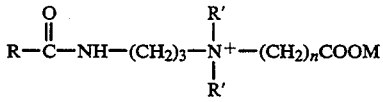

(IV)

wherein R is a longer hydrophobic hydrocarbon group which suitably is a saturated or unsaturated, straight or branched aliphatic hydrocarbon group with at least 7 carbon atoms. R suitably has from 7 to 21 carbon atoms and is preferably an alkyl or alkenyl group with from 11 to 17 carbon atoms. R′ is an alkyl or hydroxyalkyl group with from 1 to 4 carbon atoms, suitably both groups R′ are methyl groups, and n is 1 or 2. M is preferably hydrogen or a sodium ion.

According to the present invention it has been found that a combination of the three above given types of amphoteric compounds, in certain ratios, gives unusually good properties in dishwashing compositions based on anionic tensides. It is essential that all three types of amphoteric compounds are present. If only amphoteric compounds of type a) or b) are present the dishwashing composition will get low skin irritation but it will not show satisfactory dishwashing effect. If only amphoterics of type c) are present the dishwashing composition will get a good dishwashing effect but will not be satisfactory with regard to skin irritation. If amphoteric compounds of type a) are combined with a certain amount of amphoteric compounds of type c) a low irritating composition will not be obtained and nor will it be at a combination of type b) and type c). However, if type a), type b) and type c) are combined so that the weight ratio of amphoteric compounds of type c) to the total amount of amphoteric compounds of types a) and b) is within the range from 1:9 to 1:1.5, whereby at the same time the total amount of amphoteric compounds of type a), b) and c) is at least 9 per cent by weight of the total amount of these amphoteric compounds plus anionic tensides a composition with good dishwashing effect and low skin irritation is obtained.

The weight ratio between amphoteric compounds of type a) and type b) can vary within fairly wide limits and is normally within the range from 1:50 to 50:1. The ratio is suitably within the range of 1:10 to 10:1 and preferably within the range 1:1.5 to 1:0.5. It is essential that the amount of amphoteric compounds of type c) does not exceed the total amount of compounds of type a) plus type b) and as has been stated at least 1.5 parts by weight of amphoterics of type a) plus type b) shall be used per part by weight of amphoterics of type c). The weight ratio between amphoteric compounds of type c) to the total amount of amphoteric compounds of type a) and type b) is preferably within the range 1:3 to 1:1.5. Particularly good results have been obtained with dishwashing compositions comprising substantially equal amounts of the three different types of amphoteric compounds. The total amount of amphoteric compounds of type a), b) and c) is at least 9 per cent by weight, based on the total weight of anionic tenside and the amphoteric compounds, and suitably at least 15 per cent by weight. The amount can reach 40 per cent but usually it does not exceed 25 per cent.

The anionic tensides in the dishwashing compositions are, as conventional, water soluble sulfates or sulfonates and especially alkyl sulfates, alkyl ether sulfates, alkyl sulfonates, alkylaryl sulfonates, wherein the alkyl group usually contains from 8 to 22 carbon atoms. For anionic tensides containing ether groups these are usually ethylene oxide groups and the compounds usually contain between 1 and 10 such groups per molecule. The cations are usually alkali metals, alkaline earth metals, ammonium or amines such as mono-, di- and triethanol amine cations. As some specific examples of artionic tensides can be mentioned sodium lauryl sulfonate, sodium lauryl ether sulfate with two or three ethylene oxide groups, the corresponding ammonium or ethanol amine salts, sodium or other salts of dodecyl benzene sulfonic acid and alkyl benzene sulfonic acid wherein the alkyl group contains an average of 11 to 13 carbon atoms. Often at least two different anionic tensides are used in the dishwashing compositions. The total amount of the anionic tensides and the above mentioned amphoteric compounds in complete liquid dishwashing compositions should be at least 15 per cent by weight and is usually within the range from 18 to 45 per cent.

The present dishwashing compositions are liquid and the main component for this is of course preferably water. Water in dishwashing compositions is often deionized but other types of water can also be used. Other liquid solvents can be includes for example lower alcohols and glycols and lower alkyl ethers of the glycols. These types of solvents are normally included in minor amounts, if at all present. As some specific examples can be mentioned ethanol, ethylene glycol and monopropylene glycol etc. Solvents are sometimes included mainly as a part of a preservative agent. However, it is an advantage of the present compositions that a preservative agent is not required.

The present dishwashing compositions can be prepared in per se known manner by simple mixing of the components and they can of course be used in a conventional manner. Normal dosage is about 0.2 g per liter dishwater of a dishwashing composition having a total dry substance content of from about 10 to about 45 per cent by weight.

The essential components of the present dishwashing agents have been stated above. Of course other substances conventionally used in dishwashing compositions for improvement of certain properties can also be included, for example thickeners, coloring agents, pigments, perfumes etc. Other amphoteric compounds can be included under condition that they do not have a detrimental influence on the mildness of the compositions, and nonionic tensides, such as alkyl polyglycosides, can also be included if desired.

The invention is further illustrated in the following examples which, however, are not intended to limit the same. Parts and per cent relate to parts by weight and per cent by weight respectively, unless otherwise stated and all amounts are given as 100% active substance.

EXAMPLE 1

All the dishwashing compositions below contained a mixture of anionic tensides: 10.8 grams of a C12-C18 alkane sulfonate and 5.6 g of sodium lauryl ether sulfate with 3 ethylene oxide groups. The amphoteric compounds used were: Amphoteric compound of type a)-Ampholak(®)7TX(sold by Berol Nobel AB, Sweden) according to formula (II) wherein R is a residue of tallow fatty acid.

Amphoteric compound of type b) - Ampholak(®)X-CO-30 - (sold by Berol Nobel AB,Sweden) - mixture of compounds according to formulae (IIIa) and (IIIb) wherein R is a residue of coco fatty acid.

Amphoteric compound of type c) - Ampholak(®)-BCA-30 - (sold by Berol Nobel AB, Sweden) - according to formula (IV) wherein R is a residue of coco fatty acid.

| Composition No. | Amph. type (a) g | Amph. type (b) g | Amph. type (c) g |
|---|---|---|---|
| 1 | 3.6 | — | — |
| 2 | — | 3.6 | — |
| 3 | — | — | 3.6 |
| 4 | 2.4 | — | 1.2 |
| 5 | — | 2.4 | 1.2 |
| 6 | 1.2 | 1.2 | 1.2 |
| 7 | 0.6 | 0.6 | 0.6 |

The compositions 1, 2, 3, 6 and 7 were investigated with regard to their dishwashing effect. This effect of the compositions was evaluated by dishwashing in practice. 1 ml beef tallow with an iodine number of 55.1 was applied to each plate and the plates were then left to dry overnight at room temperature. 8 1 of water having a concentration of 0.2 g/1 of each tested composition and having a hardness of 20° dH were used at a temperature of 45°+−2° C. After foam formation the dried plates covered with beef tallow were cleaned with a brush until the foam collapsed. The results were noted as number of cleaned plates and are given in the table below.

| Composition number | Number of cleaned plates |
|---|---|
| 1 | 7 |
| 2 | 9 |
| 3 | 20 |
| 6 | 16 |
| 7 | 13 |

As evident compositions comprising only amphoterics of type a) or b) (compositions 1 and 2) do not give satisfactory cleaning effect. Compositions containing only amphoteric of type c) (composition 3) gives good cleaning effect and compositions 6 and 7 according to the invention comprising combinations of the three types of amphoteric compounds give fully satisfactory effect.

The compositions 1, 2, 3, 4, 5 and 6 were investigated with regard to their dermatological properties. These tests were made according to "Soap Chamber Test" as disclosed by Frosch, P. J. and Klingman, A. M. in Cont. Derm. II, 1976, 314. The compositions were tested as 8% solutions and the development of erythema, scale and fissuring was investigated. The obtained results were weighed together to give a total classification of irritation whereby lower values indicate a more irritating composition.

| | Composition no | | | | | |
|---|---|---|---|---|---|---|
| | 1 | 2 | 3 | 4 | 5 | 6 |
| Erythema | 0.61 | 0.54 | 0.78 | 0.72 | 1.27 | 0.63 |
| Scale | 0.0 | 0.04 | 0.02 | 0.72 | 0.02 | 0.01 |
| Fissuring | 0.01 | 0.10 | 0.11 | 0.10 | 0.36 | 0.06 |
| Classification | 8 | 7 | 2 | 4 | 2 | 7 |

From the results it is evident that compositions containing only amphoterics of type a) or type b) (compositions 1 and 2) give mild dishwashing compositions but they are, however, not satisfactory with regard to dishwashing effect as shown above. Amphoterics of only type c) (composition 3) give highly irritating compositions and even if these, as in compositions 4 and 5, are utilized in combination with one of the compounds of type a) or b) no substantial improvement is obtained while composition 6 according to the invention which contains all three types and with type c) in the same amount as in the other compositions give mild dishwashing compositions and with retained good cleaning effect, as shown above.

I claim:

1. A liquid dishwashing composition comprising a combination of an amphoteric surface active compound of type (a) having the general formula

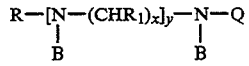

(II)

wherein R is a hydrocarbon group having from 7 to 22 carbon atoms, $R_1$ is hydrogen or a lower alkyl group of 1 to 6 carbon atoms, x is 2 or 3, y is an integer of 0 to 4, Q is the group $R_2COOM$ wherein $R_2$ is an alkylene group having from 1 to 2 carbon atoms and M is hydrogen or an ion from the groups alkali metals, alkaline earth metals, ammonium and substituted ammonium and B is hydrogen or a group Q as above defined, a compound of type (b) having the general formula (IIIa) or (IIIb)

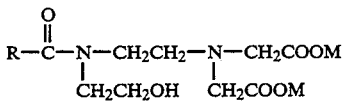

(IIIa)

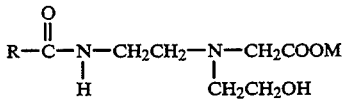

(IIIb)

wherein R and M have the same meanings as set forth above a compound of type (c) having the general formula

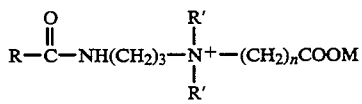

(IV)

wherein R is a longer hydrophobic hydrocarbon group having from 7 to 21 carbon atoms, R′ is an alkyl- or hydroxyalkyl group having from 1 to 4 carbon atoms, n is 1 or 2 and M is hydrogen or a sodium ion, and an anionic tenside consisting of a water-soluble sulfate or sulfonate tenside selected from the group consisting of alkyl sulfates, alkyl ether sulfates, alkyl sulfonates, and alkylaryl sulfonates, wherein the alkyl group contains from 8 to 22 carbon atoms, whereby the weight ratio between amphoteric compounds of type (c) and the total amount of amphoteric compounds of type (a) and type (b) is within the range of from 1:3 to 1:1.5 and whereby the total amount of amphoteric compounds of type (a), (b) and (c) is between 15 and 25 percent by weight based on the total amount of these and the anionic tenside, and the weight ratio between compound (a) and (b) is between 1:1.5 and 1:0.5.

2. A composition according to claim 1 wherein the total amount of amphoteric compounds of type (a), (b) and (c) and anionic tenside is at least 15 percent by weight, based on the weight of the total liquid composition.

* * * * *

UNITED STATES PATENT AND TRADEMARK OFFICE

CERTIFICATE OF CORRECTION

PATENT NO. : 5,340,502

DATED : August 23, 1994

INVENTOR(S) : Jadwiga PALICKA

It is certified that error appears in the above-indentified patent and that said Letters Patent is hereby corrected as shown below:

On the title page, item [73], "Novel" should be --Nobel--.

Signed and Sealed this

Twenty-seventh Day of December, 1994

*Attest:*

Bruce Lehman

BRUCE LEHMAN

*Attesting Officer*

*Commissioner of Patents and Trademarks*